United States Patent [19]

Sullivan

[11] Patent Number: 4,475,438

[45] Date of Patent: Oct. 9, 1984

[54] GAS OPERATED, AUTOMATIC OR SEMI-AUTOMATIC GUNS

[75] Inventor: Leroy J. Sullivan, Faber Heights, Singapore

[73] Assignee: Chartered Industries of Singapore Private Ltd., Jurong Town, Singapore

[21] Appl. No.: 538,833

[22] Filed: Oct. 4, 1983

Related U.S. Application Data

[63] Continuation of Ser. No. 280,715, Jul. 6, 1981, abandoned.

[30] Foreign Application Priority Data

Dec. 11, 1980 [GB] United Kingdom ..... 8039746

[51] Int. Cl.[3] ..... F41D 11/12

[52] U.S. Cl. ..... 89/191 R; 89/185; 89/199

[58] Field of Search ..... 89/42 B, 159, 180, 185, 89/187 CB, 191 R, 191 A, 192, 199

[56] References Cited

U.S. PATENT DOCUMENTS

| | | | |
|---|---|---|---|
| 1,388,856 | 8/1921 | Fox | 89/185 |
| 2,146,185 | 2/1939 | Holek | 89/42 B |
| 2,487,198 | 11/1949 | Swebilius | 89/191 R |
| 3,003,400 | 10/1961 | Johnson | 89/191 R |
| 3,225,657 | 12/1965 | Kruzell | 89/191 R |
| 3,227,045 | 1/1966 | Kruzell | 89/191 R |
| 3,675,534 | 7/1972 | Beretta | 89/191 R |
| 3,931,690 | 1/1976 | Soucy et al. | 42/16 |
| 3,990,346 | 11/1976 | Irwin | 89/191 R |
| 4,019,423 | 4/1977 | Johnson | 89/178 |
| 4,269,109 | 5/1981 | Stoner | 89/191 R |
| 4,358,986 | 11/1982 | Giorgio | 89/199 |

FOREIGN PATENT DOCUMENTS

| | | | |
|---|---|---|---|
| 538113 | 11/1955 | Belgium . | |
| 697256 | 10/1940 | Fed. Rep. of Germany . | |
| 1050240 | 2/1959 | Fed. Rep. of Germany . | |
| 1151326 | 1/1958 | France . | |
| 1405239 | 5/1965 | France . | |
| 244082 | 8/1946 | Switzerland | 89/191 R |
| 15774 | of 1914 | United Kingdom . | |
| 333968 | 8/1930 | United Kingdom . | |
| 576024 | 3/1946 | United Kingdom . | |
| 836796 | 6/1960 | United Kingdom . | |
| 1039840 | 8/1966 | United Kingdom | 89/187 CB |
| 2043845 | 10/1980 | United Kingdom . | |

*Primary Examiner*—Stephen C. Bentley
*Attorney, Agent, or Firm*—Ladas & Parry

[57] ABSTRACT

A gas operated gun having a receiver (1) including a rear wall (100) at one end and a barrel (10) at the other end and a bolt carrier assembly (3) reciprocal within the receiver is arranged to co-operate with a main drive spring (307) that urges the bolt carrier assembly toward the barrel. The gun is designed so that in one aspect of the invention on an automatic cocking cycle the bolt overtravels the cartridge feed station by an amount equal to or greater than the overall length of a live cartridge.

In a further aspect, the gun is additionally designed using parameters calculated such that a substantially constant reaction is felt by a user. The parameters involved are essentially the product of sprung weight (the total weight in kg. of all components driven by the main spring)×springing force (an average value of spring force that accelerates and retards the sprung weight)×cycling distance (the length of allowable travel of the bolt carrier assembly in meters) is equal to $(0.51)^2 \times 0.5$ g±15% where I is the cartridge impulse and g is the acceleration due to gravity. The length of allowable travel of the bolt carrier assembly is arranged such that the assembly does not impact a positive stop (100).

25 Claims, 24 Drawing Figures

Figure 2A:
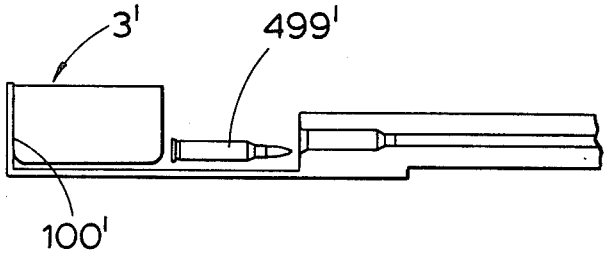

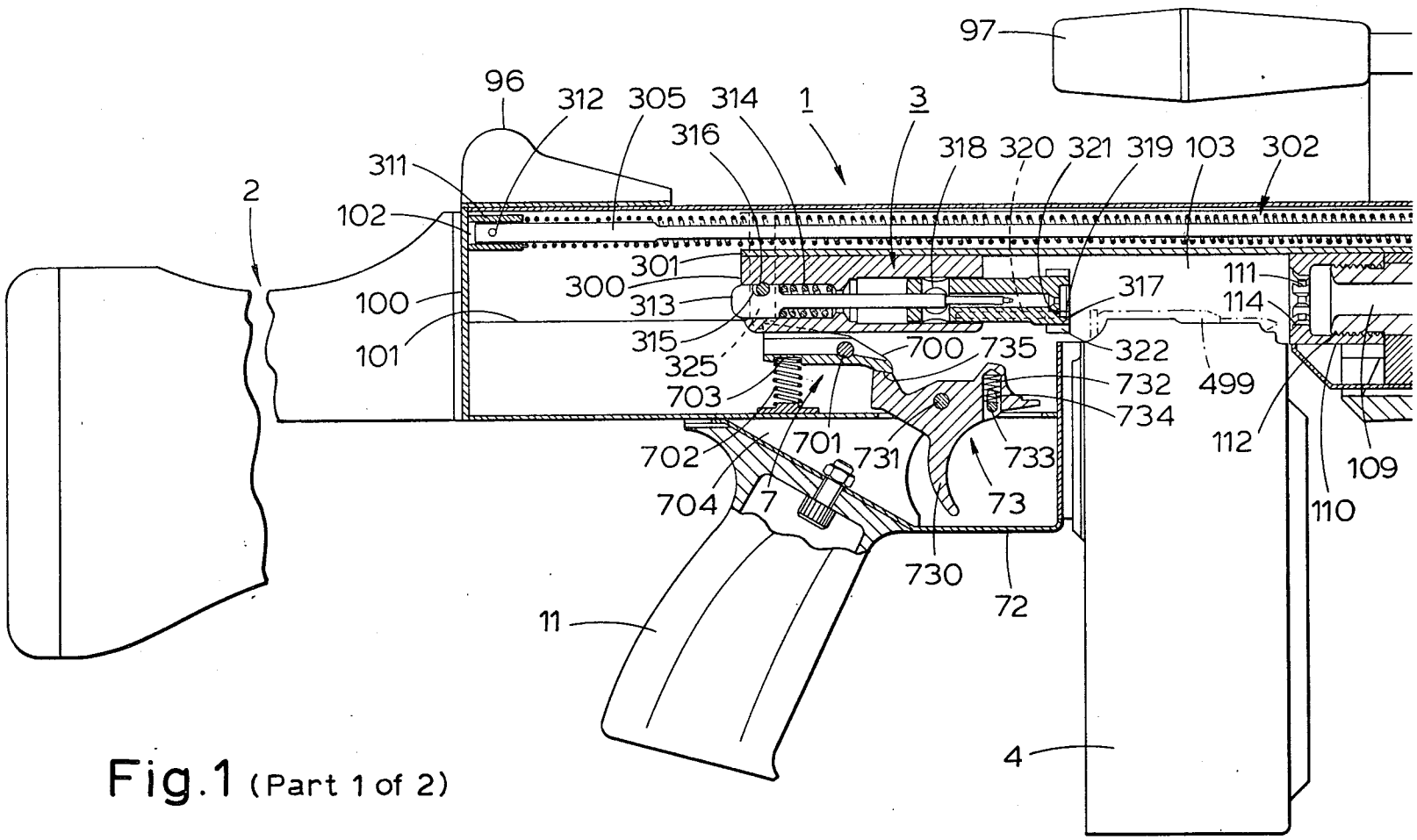
Fig. 1 (Part 1 of 2)

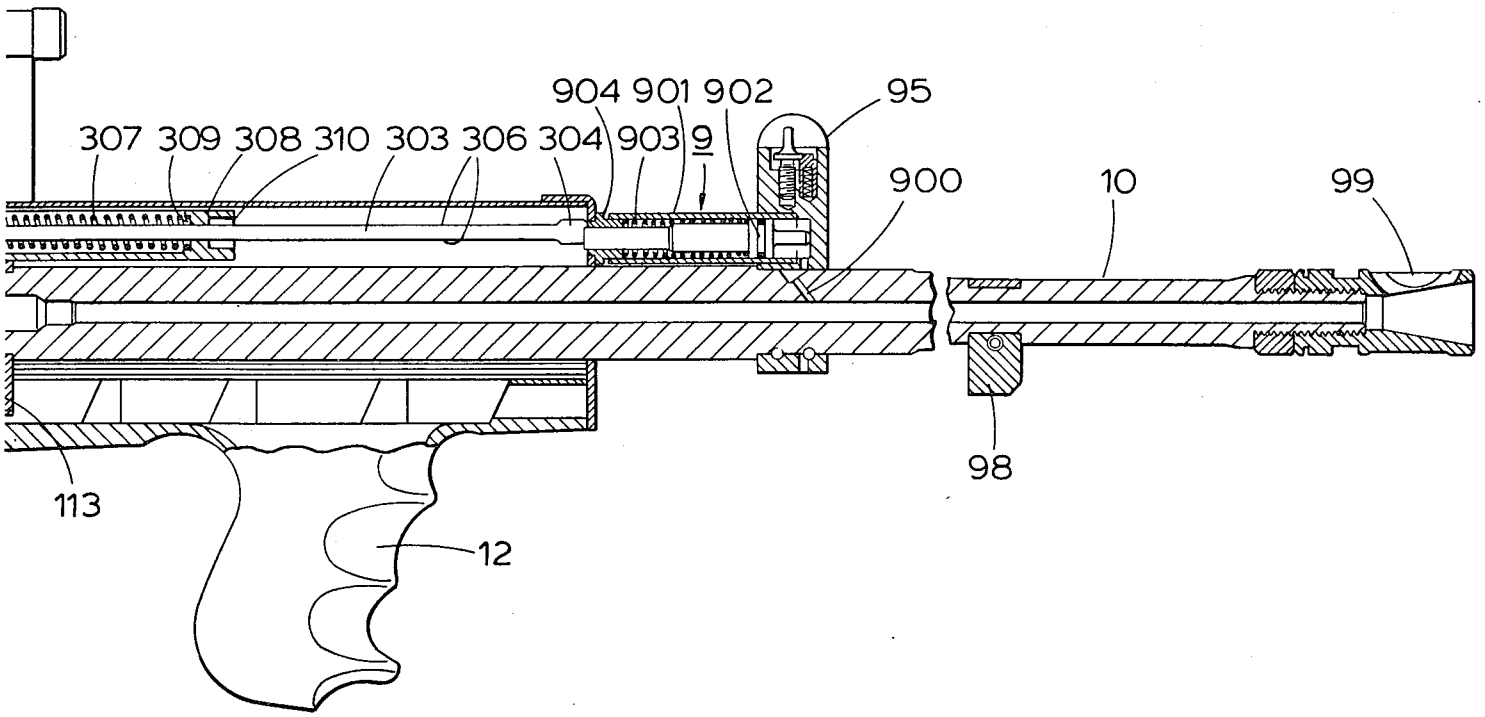
Fig. 1 (Part 2 of 2)

GAS OPERATED, AUTOMATIC OR SEMI-AUTOMATIC GUNS

This is a continuation of co-pending application Ser. No. 06/280715 filed July 6, 1981 now abandoned.

This invention relates particularly to gas operated automatic guns, although it may also be used with semi-automatic guns.

Automatic guns are well known and the term is applied to a gun in which, when a trigger is pulled, a plurality of cartridges are fired serially for as long as the trigger is held or until the last cartridge is fired. Semi-automatic guns are similarly well known and the term is usually applied to a gun which, when a trigger is pulled, fires a cartridge, subsequently ejects the cartridge, cocks the bolt and chambers a next cartridge automatically but does not fire said next cartridge until the trigger is released and again pulled to repeat the cycle.

Automatic and semi-automatic guns are well discussed in literature and examples are "Small Arms of the World" by W. H. B. Smith, tenth edition completely revised by Joseph E. Smith published by Stackpole Books, Harrisburg, Pennsylvania, U.S.A., and "Janes Infantry Weapons" 1977, edited by Dennis H. R. Archer, published by Janes Publishing Company, and a known type of gas operated, automatic gun is the United States 7.62 mm NATO M60 machine gun described at pages 695–699 in "Small Arms of the World" and pages 332–337 of "Janes Infantry Weapons" and the 5.56 mm AR18 rifle described at page 656 in "Small Arms of the World" and pages 229–231 of "Janes Infantry Weapons".

There are three principle types of automatic guns, namely recoil operated, blow-back operated and gas operated. The recoil operated gun is generally not suitable for a hand held weapon because it is sensitive to mount stiffness and elevational altitude. Blow-back guns, though still in use by infantry, are operable only with low power, short-range cartridges and, thus, the gas operated gun is preferred by present day infantry because of its improved reliability since it is not so susceptible to fouling by mud and grit, etc., and because it can use a reasonably high power cartridge.

A gas operated gun, such as the AR18, has a receiver housing, a bolt/bolt carrier assembly which is urged toward a barrel by a drive spring and actuated by a trigger through the intermediary of a sear. A radial drilling through the wall of the barrel is provided at a predetermined distance along the barrel length and externally in co-operation with the drilling is a gas piston and cylinder assembly. In operation, the bolt/bolt carrier assembly strips and feeds a cartridge from a magazine into a feed area within the receiver and the bolt drives the cartridge over a feed ramp within the normally provided barrel extension to chamber the cartridge. The bolt is usually then rotated into a locked position so that the cartridge is securely held within the chamber. Either a hammer is then released to strike the firing pin or the final forward momentum of the bolt carrier assembly rotates and locks the bolt as it drives the firing pin into the cartridge to thereby discharge the cartridge. Gas pressure is produced by the firing action of the cartridge, which gas enters the radial drilling once the bullet has passed the drilling and enters the gas cylinder whilst the bullet is still within the barrel. Of course, once the bullet leaves the barrel the gas is dissipated. The cylinder, arranged to be the movable part, is connected to the bolt carrier assembly by a rod so that as the cylinder fills with gas it is driven by the gas, the bolt carrier is driven rearwardly thereby unlocking the bolt, extracting the spent cartridge, ejecting the same and cocking the gun for a further series of operations. A further, similar, cycle is then produced for as long as the trigger is squeezed and, of course, for as long as there are cartridges to provide the gas discharge. It is to be noted that the movable cylinder, or where appropriate piston, does not necessarily have the same length of travel as the bolt carrier assembly.

The AR18 rifle, along with several other automatic weapons, fires from a closed bolt position, which means that the bolt/bolt carrier assembly are all the way forward and a round has been chambered by the preceding cycle so that, when the trigger is pulled, only the hammer or other lightweight firing mechanism moves; the bolt and carrier assembly do not move until after firing takes place and there is no consequential motion or force applied to the gun before the instant of firing. This is in distinction to a gun which fires from the open bolt position (such as an M60 machine gun) where the bolt-/bolt carrier assembly are held back behind the feed area by the previous cycle being interrupted and the bolt carrier being caught by a sear before the bolt/bolt carrier assembly are driven all the way forward by the drive spring. Thus, initially no cartridge has been chambered and when the trigger is pulled the bolt/bolt carrier assembly is released and driven forward by the main spring to then chamber and fire the cartridge. When firing from the open bolt position there is a rearward force applied to the gun before the instant of firing due to the reaction of the drive spring in pushing the bolt carrier forward.

In the cycle of operations, the bolt carrier travels to a rearward position so as to permit a further round to be fed and chambered. Such feed overtravel is defined herein as the distance in meters between the front of the bolt (in its extended position relative to the bolt carrier) and the base of the cartridge in the feed, e.g. the magazine delivery port, measured with the rear of the bolt carrier just touching the positive stop which includes a buffer if present. Note the front of the bolt is usually the stripping shoulder that contacts the base of the cartridge and drives the cartridge forward, out of the feed, and towards the chamber as the bolt carrier assembly moves forward. The term "stripping shoulder" applies (instead of "front of the bolt") to weapons that do not strip with the front of the bolt.

In known gas operated guns it is normal for the bolt carrier to impact the rear wall of the receiver to limit the extent of rearward travel, and in many known guns, such as the M16, described at pages 650–653 in "Small Arms of the World" and pages 226–228 of "Janes Infantry Weapons", the impact is through the intermediary of a buffer.

By the term "buffer", as used herein, is meant a means which is interposed between the bolt carrier assembly and the stop to rapidly retard the bolt carrier and which has a force at least twice greater than that of all the other combined spring force averages.

So as to achieve reliability, any automatic or fully automatic gun must provide the bolt/bolt carrier with sufficient energy for the bolt/bolt carrier to overtravel the cartridge feed station and such overtravel must be sufficiently great to allow time for the cartridge to travel to a position whereby it may be stripped by, for example, the stripping shoulder of the bolt from the cartridges with which it is stacked. Although gas operated guns are less susceptible to fouling they do become dirty and for this reason a gun designer must provide the bolt/bolt carrier assembly with sufficient energy to overtravel the feed station even when the gun is operating in a dirty condition. For this reason, some gas operated guns are provided with a manually adjustable gas controlled system so that a user may increase the gas pressure if the experience is found that cartridges are not permitted sufficient time to move to a feed position. In gas operated guns where no gas system control is provided the gas system is arranged to provide the bolt/bolt carrier assembly with sufficient energy to overtravel the feed station under the adverse conditions.

However, as described above for the M16 assault rifle, it is normal for the rearward extent of travel of the bolt carrier to be limited by a buffer impacting the rear wall of the receiver, and the buffer is provided in an attempt to absorb the shock of the bolt carrier impacting the rear receiver wall. The bolt carrier with or without a buffer bounces off the rear wall of the receiver and it will be realised that by increasing the gas pressure in the gas system to increase the energy driving the bolt/bolt carrier assembly rearwardly, so the energy with which the bolt carrier strikes the receiver wall will increase. This has the effect that the travel time from the minimum overtravel position, which permits a cartridge sufficient time to move to the feed station, to the time the bolt stripping shoulder is driven forwardly by the main spring and attempt to strip a cartridge is reduced, because the bolt carrier assembly is driven rearwardly faster and bounces off the rear wall and returns forwardly faster. Thus, if the energy imparted to the bolt/bolt carrier assembly by the gas pressure exceeds a predetermined value so, once again, insufficient time is permitted for a cartridge to move to the feed station.

In gas operated guns numerous attempts have been made to lessen the effect of the bolt carrier striking the rear receiver wall, although these attempts have been made for the sake of reducing the shock effect of the bolt carrier assembly driving the rear wall of the receiver in a backward direction. The term "restitution" is applied to this phenomenon and means a proportion of energy from an impacting mass which is returned to that mass upon striking a fixed, solid object. Thus, if a steel bolt carrier strikes a steel rear wall of the receiver, most of the energy of the impacting carrier assembly will be returned to the carrier in the opposite direction by the rear receiver wall. In such an instance there is approaching 100% restitution, and the AR18 is an example.

In the M16 rifle, an attempt has been made to reduce restitution by providing a buffer carrier by the rear bolt carrier assembly so as to absorb some of the energy of the impacting bolt on the rear receiver wall. The buffer is compressible between the rear receiver wall and the rear of the impacting bolt carrier assembly. Although the coefficient of restitution of the M16 is considered to be low, it is still found that significant recoil is caused by the rear receiver wall being impacted by the bolt/bolt carrier assembly and, by direct correlation, so the bolt/bolt carrier assembly rebounds with a significant amount of energy. It is one object of this invention to provide a gas operated gun in which the aforementioned adverse effects of impact relative to reliable feed of known weapons are substantially mitigated.

According to one aspect of this invention there is provided a gas operated gun including a receiver having a rear wall at one end and a barrel at the other end, the said receiver also having a cartridge feed station, and movable within the receiver a bolt means arranged to co-operate with a main drive spring which urges the bolt means toward the barrel, the arrangement of the receiver and bolt means being such that feed overtravel is provided equal to or greater than the overall length of a live cartridge.

By utilising a construction where the feed overtravel is equal to or greater than the overall length of a live cartridge, an exceptional amount of overtravel, compared with known gas operated guns, is provided and so the time permitted for a cartridge to move to the feed station is greatly increased. With the arrangement of the present invention, the rearward extent of travel of the bolt means is normally such that it does not impact the rear receiver wall and so the problems of rebound associated with impact are, hence, overcome. As noted above, known gas operated guns suffer from recoil blow and not only is there is a recoil from the gun when the bolt carrier assembly strikes the rear receiver wall, but there is also a recoil blow from the gun when the cartridge fires. There are, thus, two recoil spikes which occur at opposite ends of a time cycle, i.e. one spike is when the bolt carrier assembly is at its rearmost position and the other spike is when the bolt carrier assembly is at its foremost position adjacent to the barrel. The effect of recoil upon the user of the gun is that whilst the first round may be on target, subsequent rounds cause the barrel of the weapon to rise so that shots are fired above target. It must be remembered that such automatic weapons usually fire of the order of 10-rounds per second and it takes some time, of the order of 1–2 seconds, before the user of the weapon is able to compensate for the recoil effect and bring his aim back on to target. Such weapons, due to loss of control by the user, tend to be inaccurate.

Although the loss of control can be substantially mitigated in both the previously mentioned blow-back and recoil guns, the solution employed in those guns have not heretobefore been thought applicable to gas operated guns because of the operational differences between the types of guns.

The recoil effect of a gas operated gun is normally considered less than that of a bolt action gun which, although not automatic, contains many similarities with a gas operated gun. In this respect, they both have a locked and rigid structure that tries to deliver the cartridge impulse during "bore" time. The lighter recoil has been attributed to the gas in the cylinder not only driving the moving memeber (be it the cylinder or piston) and thereby the free mass of the bolt carrier assembly rearwardly, but also the gas driving the front wall of the fixed member in a forward direction. Thus, gas operated guns tend to have a "softer" action than the aforesaid bolt action gun. Nonetheless, the effect of recoil is still as described above, i.e. the user loses aim after the first shot has been fired and it is evident that the cause of the user losing aim is because of the number of differing recoil actions that occur which are experienced by a user as a series of separate sharp blows. Various attempts to overcome recoil have been made and reference may be paid to "Hatcher's Note Book" by Julian S. Hatcher, published in the United States of America by the Telegraph Press, 3rd Edition, 2nd printing April 1976, page 262 et seq.

Because of the action of recoil on the controllability of known gas operated guns, efforts to improve the hit probability of such gas operated guns include three shots bursts limiters, high rate rifles that fire three to four shots extremely quickly so that the gun does not have time to move of target and duplex or triplex cartidges that fire two or three bullets with each shot. None of these devices have proved successful and have merely shown the desperation of designers to improve the accuracy of a gas operated automatic gun. It is a further object of this invention to improve controllability of a gas operated gun.

According to a further aspect of this invention there is provided a gas operated gun including a receiver having a rear wall at one end and a barrel at the other end, said receiver also having a cartridge feed station, and movable within the receiver a bolt means arranged to co-operate with a main drive spring which urges the bolt means toward the barrel whereby the product of sprung weight×spring force×cycling distance, each as hereinafter defined, is equal to $(0.5I)^2\times 0.5\ g\pm 15\%$ where I is cartridge impulse and g is acceleration due to gravity, the receiver and bolt means being arranged so that the bolt means does not impact a positive stop and feed overtravel is provided equal to or greater than the overall length of a live cartidge.

Normally I is given by $$\frac{\text{Bullet Weight (kg)} \times \text{Bullet Velocity (mps)}}{\text{g (mpsps)}} + \frac{\text{Powder Weight (kg)} \times \text{Powder Velocity (mps)}}{\text{g (mpsps)}}$$

and as an example, for a standard 5.56×45 mm cartridge, $$I = \frac{0.00357 \times 991.3}{9.81} + \frac{0.00169 \times 1372.5}{9.81} = 0.597 \text{ kp-secs.}$$

By "spring force" is meant herein an average value of spring forces that decelerate the sprung weight (as hereinafter defined) as it travels rearward and accelerate the weight as it travels forward. The avergae is determined by distance, not by time. If the weight cocks a hammer or other firing mechanism as it travels rearward the force of the spring of such a firing mechanism is part of the average. The sum total of all spring force averages, whether they add or subtract from the main drive spring, determines the "spring force" but does not include the force of a buffer. The "spring force" excludes friction which cannot be accurately measured. It is determined by standard spring mathematical formulae as defined by the Associated Spring Corporation headquatered at the Wallace Barnes Division, 18, Main Street, Bristol, Connecticut 06010, United States, an internationally recognised authority. Thus, where a swinging hammer is employed the product sprung weight×spring force×cycling distance is given by:

$$\tfrac{1}{2}[(EC+EH)(WC+WH)+(EC.\ WC.+EH.\ WH.)]$$

where EC=energy of bolt carrier assembly
EH=energy of hammer
WC=weight of carrier in kg.
WH=weight of hammer in kg.
and
EC=average bolt carrier assembly main spring force×bolt carrier assembly cycling distance in mKg.
EH=average hammer spring force×hammer spring deflection distance in mKg.

It will be appreciated by those skilled in the art that where a torsion spring is employed for the hammer a direct conversion can be made to linear values.

By "sprung weight" is meant the total weight in kilograms of all components driven forward by the main spring. For a gas operated gun these usually include, but are not limited to, the bolt assembly, bolt carrier (or operating rod assembly, known per se) and half the weight of the main drive spring. When applicable, it would also include the cocking handle (as in the known AK-47) and buffer if the buffer travels with the bolt carrier as in the M-16.

The term "cycling distance", used herein, is defined as the length of allowable travel of the bolt carrier (or operating rod assembly) measured in meters. Distance is for half cycle and is the total length the bolt carrier (or operating rod assembly known per se) can move from the front of the receiver to the rear without hitting a "positive stop", by which term is also meant to be included a buffer.

In a currently preferred embodiment the product of sprung weight ×spring force ×cycling distance is equal to $(0.51)^2\times 0.5g\pm 5\%$. Preferably, the gun is arranged to fire from the open bolt position as hereinbefore defined.

Conveniently, the bolt means comprises a bolt carried by a reciprocable bolt carrier assembly. Usually the bolt is movable over a predetermined distance with respect to the bolt carrier assembly.

So that the bolt/bolt carrier assembly may be driven rearwardly to compress the main drive spring the bolt carrier assembly is extended forwardly longitudinally with the barrel to the region of the normally provided barrel gas port which is connected to a cylinder containing a piston arranged to contact and provide rearward impetus to the bolt carrier assembly.

Advantageously, the main drive spring is mounted on a guide means which is located forwardly adjacent said cylinder and rearwardly adjacent the receiver rear wall and, preferably, the rearward location of the guide means is on the interior of the rear receiver wall, the exterior rear receiver wall being in abutting relationship with a buttstock.

The terms "forward" and "rearward" and similar adverbial phrases used herein are used in relation to the gun muzzle so that, for example, the buttstock is positioned rearwardly of the muzzle.

Figure 2B:
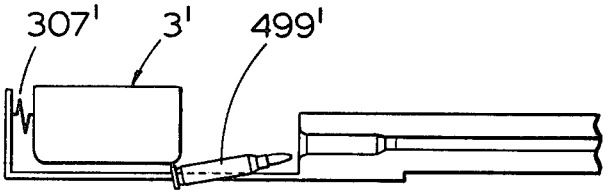
Figure 3A:
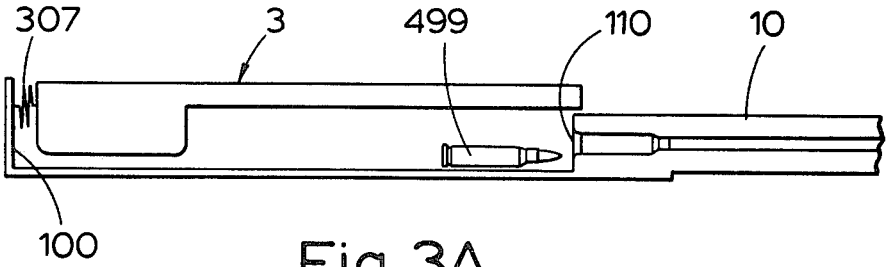
Figure 3B:
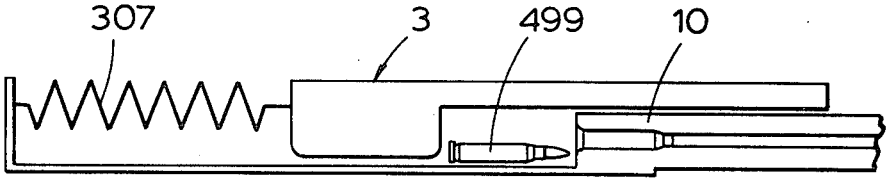
Figure 4A:
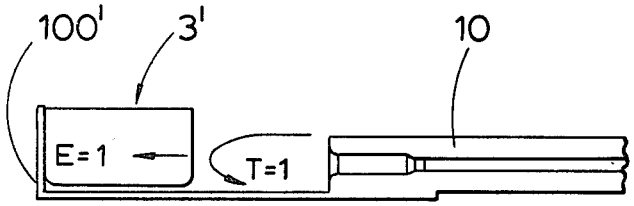
Figure 4B:
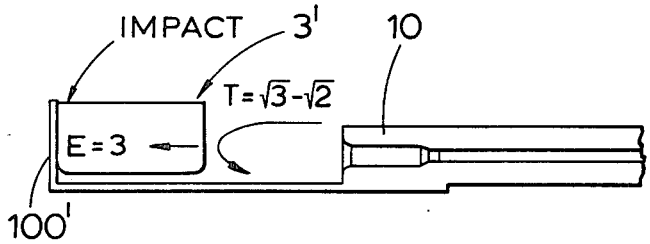
Figure 5A:
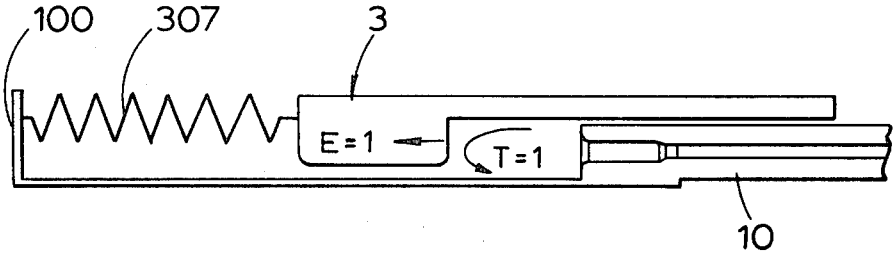
Figure 5B:
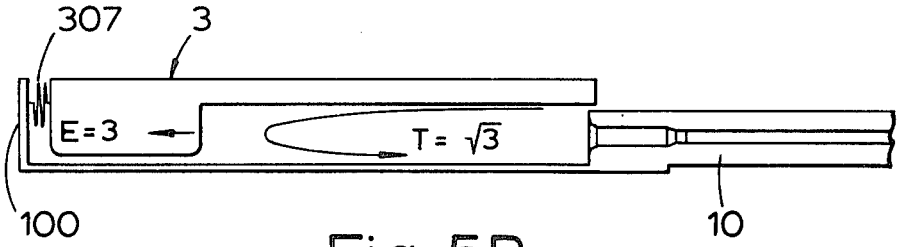

The invention will now be described, by way of example, with reference to the accompanying drawings, in which:

FIG. 1 shows a longitudinal cross-sectional view of a gas operated, fully automatic, gun in accordance with this invention, FIGS. 2A and 2B show the maximum and minimum feed overtravel in known gas operated guns, FIGS. 3A and 3B show the maximum and minimum feed overtravel in the present gun, FIGS. 4A and 4B show the effects of differing amounts of energy from a cartridge on a known gas operated gun, FIGS. 5A and 5B show, in comparison to FIGS. 4A and 4B, the effects of differing amounts of energy from a cartridge on the present invention in said one aspect, FIGS. 6A–6E show schematically the operation and impulse forces on a gun in accordance with the further aspect of the invention firing from an open bolt position, FIGS. 7A–7E show graphs representative of the reaction/counter-reaction forces of the gun shown in FIGS. 6A–6E respectively.

Figure 8A:
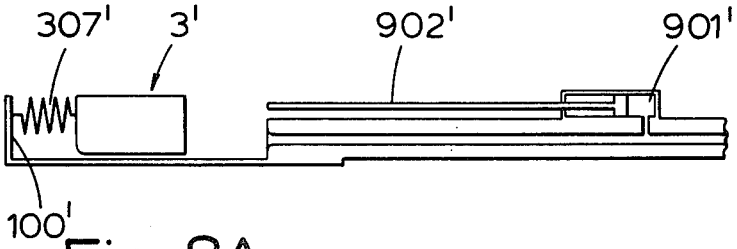
Figure 8B:
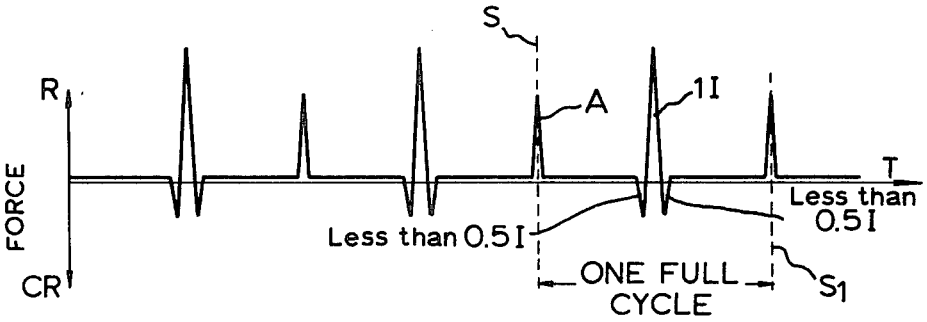
Figure 9:
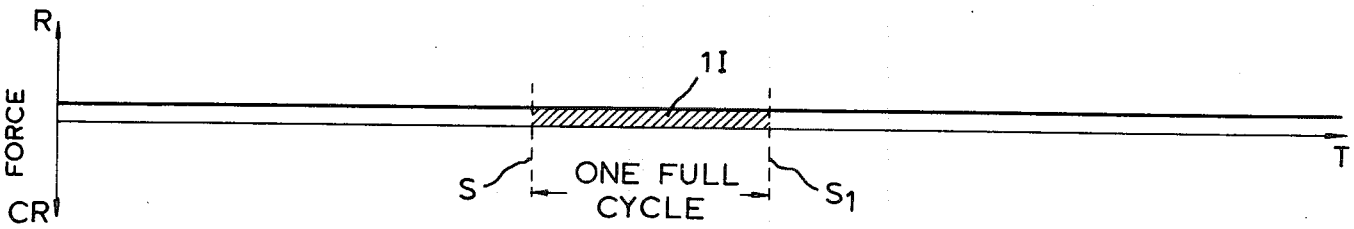
Figure 10:
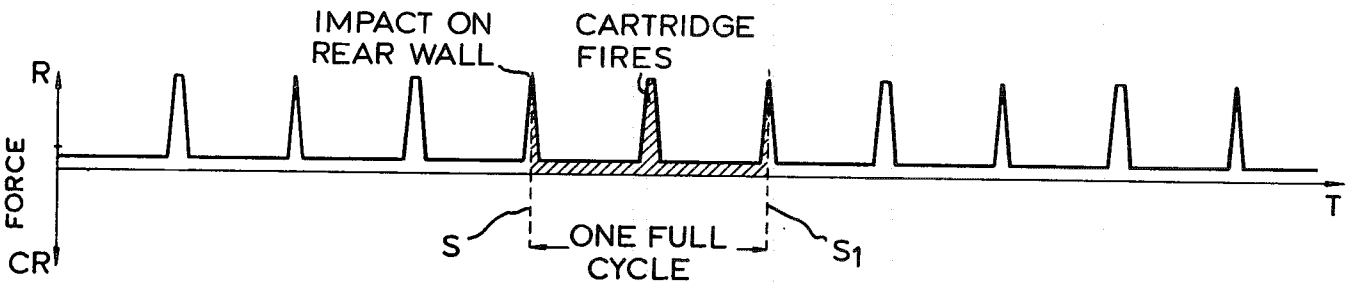

FIGS. 8A and 8B respectively show, in schematic and graphical form, the operation of a known gas operated gun firing from the open bolt position, FIG. 9 shows a graph of the reaction presented to a user of the gun in accordance with the further aspect of this invention, and FIG. 10 shows a comparative graph to FIG. 5 demonstrating the reaction presented to a user of a known gas operated gun.

In the Figures like reference numerals denote like parts.

The gas operated automatic gun shown in FIG. 1 has a receiver 1 to the rear wall 100 of which is connected a buttstock 2 and at the opposite end of the receiver 1 from the buttstock 2 there is connected a barrel 10. A pistol grip 11 is connected by a screw and nut underneath the receiver 1 and a fore grip 12 is connected on the underside of the barrel 10. The pistol grip 11 is connected to the receiver 1 through the intermediary of a trigger guard 72 shrouding a trigger assembly 73 having an arcuate finger pull trigger 730 pivotably mounted on a rod 731, the trigger 730 being biassed by a spring 732 acting in a blind hole within the trigger with one end of the spring against the inside of the blind hole and the other end of the spring against a trigger spring retainer 733 which is stationary with respect to the receiver. The retainer 733 is located in a guide slot 734 in the trigger 730. A top rear face 735 of the trigger 730 acts against the conventionally supplied sear assembly 7 having a sear 700 pivotally mounted on a transverse rod 701 which passes through into opposing side walls of the receiver. The sear 700 is biassed into a non-firing position by a compression spring 702 located between a recess 703 in the sear 700 and a stud 704 mounted on the base of the receiver.

A bolt carrier assembly 3 is slidably mounted upon a rail 101 in the receiver and the bolt carrier assembly comprises a block 300 which is suitably shaped to contact with the rail 101 and in which is secured vertical (as shown in FIG. 1) sear locking lugs 325, one on each side of the gun longitudinal axis (only one of which is shown in the section view of FIG. 1). Secured, for example, by welding to the top of the block 300 is a "P" cross-sectionally shaped sheet member 301 with the upright of the "P" being horizontally disposed so the "P", as it were, lies on its back. Inside the wrapped over, enclosed, portion of the "P" is a spring biassed antibounce weight (not shown) and longitudinally disposed adjacent to the non-enclosed portion of the "P" is a main drive spring assembly 302. For ease of explanation, it should here be stated that the main drive spring assembly 302 has been shown as if it were on the axial centre line of the gun but, in practice, the assembly 302 is offset to the right of the centre line when viewed forwardly. The main drive spring assembly 302 has a guide rod 303 of circular cross-section having end portions 304, 305 respectively, the part between the end portions 304, 305 being provided with parallel flats 306. Mounted over the guide rod 303 is a main drive spring 307. At the end of the P shaped member 301, remote from the block 300, is a bush 308 having a recess 309 into which the spring 307 is located and a circular cross-sectioned recess 310 to slidingly accept the end 304 of the guide rod 303. At the remote end of the main drive spring 307 from the bush 308 is a collar 311 which is secured to the guide rod 303 by a cross pin 312; the purpose of the collar 311 being to provide an end retainer for the spring 307 and to support the rear end of the guide rod 303 on a lug 102 on the receiver rear wall 100. The cross pin 312 extends through a slot in the side wall of the receiver and, hence, prevents the rear wall 100, which is slidably mounted, dropping unless the collar 311 is removed from the lug 102 by sliding the cross pin 312 forwardly.

Mounted on the longitudinal axis of the barrel and inside the block 300 is a firing pin 313 which is biassed in a rearward position by a compression spring 314 with the limits of travel of the firing pin being maintained by a slot 315 in the firing pin co-operating with a cross pin 316, the spring 314 and pin 316 being provided essentially for removal of the firing pin.

Encompassing the front portion of the firing pin is a bolt 317 which is slidingly rotatable on the longitudinal axis of the barrel inside the block 300 and is, thus, movable relative to the carrier assembly. The bolt 317 is conventionally provided with a cam pin 318, which pin 318 co-operates in known manner with a cam slot (not shown) in the block 300. Further, the bolt 317 is provided in conventional manner with an ejector pin 319 which is offset to the left (looking forwardly) of the barrel longitudinal axis and which pin is forwardly biassed by a coil spring 320, the forward extent of travel of the pin 319 being limited by a stop 321 acting in a slot in the pin 319. The bolt 317 also has a spring biassed claw (not shown since it is positioned on the right of the longitudinal centre line looking forwardly) which, in operation, engages the cannelore of a cartridge for removal of the cartridge from a chamber 109 which is situated in a barrel extension 110. At the rearward end of the barrel extension 110 are locking lugs 111 with which corresponding lugs 322 on the bolt 317 interleave and, when the bolt is rotated by the action of the cam pin 318 in its co-operating slot, locks the bolt lugs 322 into engagement with the lugs 111 so that the bolt 317 is unable to move in a rearward direction. A feed ramp 114 is provided on the lower internal periphery of the barrel extension to facilitate entry of a cartridge into the chamber 109. The barrel extension 110 which is secured to the barrel 10 by an external screw thread 112 on the barrel is connected to the receiver 1 by a block 113.

Located at a predetermined distance along the barrel 10 is a gas system 9 having a rearwardly inclined gas port 900 which is connected to a gas cylinder 901 in which operates a piston 902. The gas cylinder 901 is mounted between a conventional foresight assembly 95 and a bush 904 which is arranged to align the gas cylinder 901 with the receiver 1. A compression spring 903 biasses the piston 902 in a forward direction toward the foresight assembly 95. It will be seen that the guide rod 303 is extended forwardly of the barrel extension so that the end 304 is adjacent the bush 904. When the bolt carrier assembly is in its extreme forward position, the piston 902 is arranged to substantially abut the forward end bust 308 of the "P" shaped member 301.

The gun shown in FIG. 1 also has a rear sight mount 96, a carrying handle 97 mounted on the right hand side of the receiver (although shown for clarity), a bayonet lug 98, a flash suppressor 99 and a magazine 4 in which is shown in broken, partial, outline a cartridge 499 which is ready to enter a feed area 103 - these items, for example, may be of conventional arrangement.

The gun shown in FIG. 1 has a normally provided cocking handle (not shown) situated on the left hand side of the receiver looking forwardly, and the bolt/bolt carrier assembly are shown in the open bolt position as defined above, the gun is cocked and the bolt carrier assembly 3 is held rearwardly by the sear 700 engaging lugs 325 but, in such a position, the overtravel is much less than the length of a live cartridge (hereafter defined).

In operation with the various elements in the positions shown in FIG. 1, the trigger 730 is pulled rearwards against the force of spring 732 so that the face 735 rotates clockwise about rod 731 and, as a consequence, tilts the sear 700 against the compressive force of spring 703. As the sear 700 tilts it releases the lugs 325 thereby releasing the bolt carrier assembly 3 which is driven forwardly by the tension created in cocking the main drive spring 307. As the bolt carrier assembly 3 moves forward toward the barrel extension 110 the lower edge of the bolt strips cartridge 499 from the magazine 4 and continued travel of the bolt carrier assembly causes the cartridge 499 to ride over the feed ramp 114 in the barrel extension to thereby insert the cartridge into the chamber 109. However, as the bolt lugs 322 interleave the barrel extension lugs 111, a locking member (not shown) which normally engages the lugs 322 of the bolt to prevent rotation thereof is pushed rearwardly by a member (not shown) so as to release the bolt and, thus, enable the bolt to be rotated by the cam pin 318 along the cam slot. Rotation of the bolt 317 causes the lugs 322 on the bolt to rotate and engage, i.e. lock, with the lugs 111 of the barrel extension 110, thus locking the bolt 317 against rearward travel. The cartridge 499 is, thus, locked into the chamber 109 and the ejector pin 319 is pushed rearwardly, continued forward motion of the bolt carrier assembly 3 driving the firing pin 313 into the rear of the cartridge, thereby igniting the cartridge charge. The bush 308 of the "P" shaped member 301 is then in substantially the same plane as the front part of end portion 304.

As the cartridge fires, it produces gas pressure and when the bullet passes the gas port 900 so the gas under pressure enters port 900 to expand in the cylinder 901. Pressure in the cylinder 901 causes the piston 902 to be driven rearwardly and because the piston 902 is arranged to normally abut the bush 308 on the guide rod 303 (although, in practice, there will be a small gap between the adjacent faces owing to tolerances) so the bush 308 is driven rearwardly to compress the main drive spring 307. It is to be noted that the length of travel of the piston 902 is much less than that of the bolt carrier assembly 3, the piston stopping against a shoulder but the bolt carrier assembly continuing rearwardly due to the energy and impulse stored within its mass during acceleration by the gas system. Because the gas pressure in the barrel ceases as soon as the bullet leaves the barrel, the position and amount of gas permitted to enter the gas cylinder 901 is carefully arranged.

The rearward motion of the bolt carrier assembly 3 and, hence, cam slot causes the cam pin 318 to retraverse the cam slot and thereby rotate and unlock the bolt lugs 322 from the barrel extension lugs 111. Continued rearward motion of the bolt carrier retracts bolt 317 and causes the cartridge extraction claw (not shown) carried by the bolt, which when in the locked position engages the cannelore of the cartridge, to pull rearwardly on the cartridge and to, thus remove the cartridge from the chamber 109. Further rearward motion of the bolt carrier assembly 3 causes the spent cartridge to align with an ejector slot (not shown) in the right hand side of the receiver. The ejector pin 319 due to its offset on the left side of the longitudinal axis of the spent cartridge and the claw on the bolt holding the right side of the cartridge, combined with the spring tension of spring 320 causes the pin 319 to push forwardly so the cartridge is ejected out of the ejector slot. Continued rearward motion of the bolt carrier assembly uncovers the top cartridge in the magazine and carries the lugs 325 beyond the rear of the sear 700 so as to thereby recock the gun.

In an automatic cycle, such as has just been described, the distance that the bolt stripping shoulder travels past the rear of a cartridge in the feed station is dimensioned in the currently preferred embodiment to be 1.8×the overall length of a live cartridge which is defined as the inside fore and aft length of the weapon magazine that confines the cartridge. Although the overtravel in the presently preferred embodiment is 1.8×the overall length of the live cartridge, it has been found that none of the gas operated guns of which the present applicants are currently aware, can provide an overtravel in excess of 0.8×length of a live cartridge. The provision of excess overtravel, as required in accordance with this invention, engenders the gun with advantages that will be described later herein.

Provided the trigger 730 is still squeezed, the cycle of events will repeat until such time as either the trigger is released so that the sear 700 re-engages the lugs 325 or the final cartridge is fired when, if the trigger is still squeezed, will result in the bolt finishing the cycle of events locked to the barrel extension.

A further distinguishing feature may now be noted with the present invention in that the bolt carrier assembly 3 is retarded solely by the action of the main drive spring 307 and, unlike known gas operated automatic guns, the present invention does not have a bolt carrier assembly which impacts in any way against the rear receiver wall 100. Also, the aforementioned buffer of the M16 and comparable weapons is not provided.

So as to be able to handle the widest possible cycle variations in friction, barrel, heat, gas system leaks, and inconstant cartridge performance, all known gas operated automatic guns over-drive the bolt carrier assembly; in other words the gas system gives the bolt carrier assembly more than enough rearward energy to carry it beyond the cartridge feed station, i.e. feed overtravel as previously defined is provided. In providing feed overtravel, all known gas operated guns stop the bolt carrier assembly after it has overtravelled the feed by permitting the bolt carrier assembly to impact in some way against the rear receiver wall, although, as described above, attempts are made to lessen the impact by providing a buffer. Nonetheless, a mechanical impact occurs.

The excess energy is required to ensure that even if the weapon is dirty, the gas system leaks or the cartridge is weak, the bolt carrier assembly has enough energy to overtravel the feed. If, on the other hand, the weapon is clean and well oiled, the gas system has a minimum leak, and the cartridge has full power, the excess energy in known guns causes a heavy impact blow from the bolt carrier assembly when it is stopped by the rear receiver wall. It is required that under all conditions the bolt carrier assembly overtravel the cartridge feed station so that the weapon functions reliably even under adverse conditions.

In the present gun, an impulse equal to one half of the cartridge impulse is used to drive the bolt carrier assembly rearwardly and this constitutes sufficient excess energy to achieve travel past the rear of the feed under even the most adverse conditions and yet under the most favourable conditions where the gun is well lubricated, etc., the long overtravel and main drive spring force absorb the energy imparted to the bolt carrier assembly. The energy of the bolt carrier assembly is absorbed by the main drive spring so that the bolt carrier assembly is slowed to a stop by the main drive spring before the bolt carrier can hit the rear receiver wall.

The foregoing situations are shown in FIGS. 2A, 2B, 3A and 3B and in FIG. 2A there is shown a known gas operated gun in its maximum recoil condition whereby the bolt carrier assembly 3' impacts the rear receiver wall 100' so as to permit feed of the next cartridge 499'. If the known gun did not have maximum recoil by impacting the rear receiver wall, then the overtravel is usually insufficient to feed the next cartridge thereby resulting in a misfeed, as shown in FIG. 2B. Additionally, as described in the preamble, if an excess amount of energy is imparted to the bolt carrier assembly in driving that assembly rearwardly, the assembly rebounces from the rear wall of the receiver also with greater energy. The time for the next cartridge to rise to its appropriate feed position is, again, diminished and, again, results in a misfeed.

In contrast, the present invention is designed to provide a feed overtravel distance equal to or greater than the overall length of a live cartridge. In FIG. 3A, the maximum recoil condition of the present invention is shown and it will be seen that it is arranged that the bolt carrier assembly 3 does not impact the rear receiver wall 100; in FIG. 3B there is shown the minimum recoil condition under adverse conditions and which, although less than the overtravel required in accordance with this invention still provides enough overtravel to feed the next cartridge and of course, once again, there is no impact on the rear receiver wall. By providing excess overtravel in the present invention, the weapon has a much broader range of functionality in that, with a 44% increase in friction or a 44% reduction of the gas energy, the overtravel is sufficient to cycle the weapon and feed the next cartridge. Such a wide zone has not heretobefore been achieved and, what is more, no impact of the rear receiver wall is included.

Yet another advantage of providing long overtravel is that greater time is given for a cartridge in a magazine to rise to the feed position which means that a greater number of cartridges can be held by a magazine for a given spring force. In this respect, a magazine conventionally has a throat position from which cartridges may be removed by the bolt carrier assembly and a spring urging the cartridges in the magazine toward the throat position. At the throat position is normally a set of lips which permit exit of cartridges only in an axial direction of the cartriges, i.e. the cartridges can only be slid from the magazine in the forward direction of the bolt and the bolt in operation is effective to slide a cartridge out of the lips. Therefore, the magazine spring must move all of the cartridges in the magazine far enough so that the top cartridge lifts into the path of the bolt while the bolt is being cocked and before the bolt returns forwardly to chamber the cartridge. The longer the travel time is rearwardly of the feed before the bolt returns, the larger the magazine capacity can be. It is, of course, possible to increase the magazine capacity by increasing the magazine spring force, but this has the undesirable side effects of increasing the drag on the bolt due to increased friction. Furthermore, the stronger the magazine spring the higher the stress on the spring when the magazine is fully loaded resulting in a set occurring on the spring, i.e. fatiguing the spring.

The advantageous effect of providing excess feed overtravel in the present invention is compared to conventional gas operated guns is shown in FIGS. 4A and 4B, where the bolt carrier assembly 3' is shown at its fullest rearward extent touching the rear receiver wall 100'. Referring particularly to FIG. 4A, the bolt carrier assembly 3' is assumed to be given an energy $E=1$ and the bolt carrier assembly touches the rear receiver wall. The cycle time is $T=1$. Referring now to FIG. 4B, the energy given to the bolt carrier assembly 3' is assumed to have increased to $E=3$ and because it then impacts the rear receiver wall, the bolt carrier assembly rebounds therefrom with the result that the total cycling time of the bolt carrier assembly is $T=\sqrt{3}-\sqrt{2}=0.32$.

In this case, $\sqrt{3}$ represents the time of travel if no impact were to interrupt the travel and $\sqrt{2}$ represents the time lost due to the travel distance which is not available.

When rear impact of the bolt carrier occurs more Energy means less cycling Time, but if impact does not occur then an increase in Energy means more cycling Time. The latter circumstance is highly advantageous and four important benefits are derived therefrom:

1. The lack of impact provides the opportunity for "constant recoil" which is discussed later herein. Although the lack of rear impact by the bolt carrier assembly does not of itself ensure "constant recoil" any rear impact on a buffer or rear wall eliminates the opportunity for such a provision.

2. An increase in Time reduces the rate of automatic fire which, in turn, reduces the average recoil force in direct proportion, thus increasing controllability, i.e. accuracy.

3. An increase in Time T, particularly feed time, offers the opportunity for a larger capacity magazine, thus increasing the fire power of the gun.

4. An increase in energy allows the gun to function under a greater variety of conditions, as mentioned previously, so that if the weapon is fouled with dirt, excess energy ensures that the bolt carrier assembly can still function. Conversely, if the gun is clean and well oiled, the excess energy simply expends itself by compressing the main spring further so that the bolt carrier assembly moves further rearwardly than is necessary for the functional requirements of the gun. The gun is, thus, more reliable under a greater variety of conditions.

It should now be noted that, except for magazine feed time, the reliability of all the other mechanical functions in the gun cycle are generally increased with increased energy whether or not impact occurs, but these considerations are of no consequence unless the cartridge magazine feed time, which is as important to the continuity of the gun cycle as any other function, is not reduced.

From the foregoing it will be appreciated that for a given spring force and bolt carrier assembly cycling mass, increasing cycling Time and energy without the bolt carrier assembly impacting the rear receiver wall can only be achieved by providing an increase in bolt carrier travelling distance.

The benefit of increasing the bolt carrier travelling distance in terms of cycling Time, as provided by the present gun, is shown schematically in FIGS. 5A and 5B where in FIG. 5A the bolt carrier assembly 3 is given an energy of $E=1$ and a cycle time of $T=1$. In FIG. 5B, the energy $E=3$ given to the bolt carrier assembly simply means that the bolt carrier assembly travels a greater distance and yet is so designed that it still does not impact the rear receiver wall 100. The effect of $E=3$ is, thus, simply that the cycle time is increased to $T=\sqrt{3}=1.73$. It will, therefore, be seen that whereas in the known gun, the cycle time is considerably reduced when energy is increased thus providing less time for a cartridge to raise up into the feed area, the present invention simply increases the cycle time when energy is increased. Thus, the combination of excess feed overtravel by which is meant greater overtravel when compared with known gas operated guns, and by arranging that the bolt carrier assembly does not impact the rear receiver wall, several advantages of the present invention are provided over known gas operated guns.

The theory of operation of the further aspect of the present invention will now be discussed, although it is to be understood that the utility and benefit of the present invention are not dependent upon the sufficiency or accuracy of the theory now to be advanced. It is, however, believed that the theory which follows is correct and its presentation helps in an understanding of the invention.

When a gun fires it has a recoil impulse equal to that of the bullet impulse which is given by force multiplied by time. This does not, however, mean that the gun and bullet will have the same energy since if the gun weights one thousand times as much as the bullet it has only one thousandth of the enrgy of the bullet but it has the same impulse. Taken in another way, it takes very little energy to impart a high impulse to a heavy weight.

If, at the instant of firing, the gun was suddenly pushed forward by an impulse equal to the cartridge impulse, there would be no recoil and it would not matter if the gun had a locked and rigid structure such as a bolt action gun or whether the barrel was free to recoil as in the recoil operated type of gun. This is because there would be no motion and no force transmitted to the user. If this forward push was transmitted to the gun by a heavy weight it would require very little energy. Two things occur in any gas operated gun that do give a sudden forward push as it fires:

1. the bolt impacts against the barrel extension driving the barrel forward, and
2. as the bullet passes the gas port in the barrel high pressure gas enters the gas cylinder driving the piston and accelerating the bolt carrier assembly to the rear and at the same time pushing the barrel forward.

It is significant that the bolt carrier assembly 3 is not part of the locked and rigid structure and any rear impulse it has can be transmitted slowly to the gun through the main drive spring 307. If the two occurrences that push the gun forward are arranged to have enough combined impulse to equal the firing impulse, then no recoil shock load is transmitted to the user during the instant of firing. Instead, the impulse stored in the rearward moving bolt carrier assembly would be slowly transmitted to the user via the main drive spring.

Figure 6A:
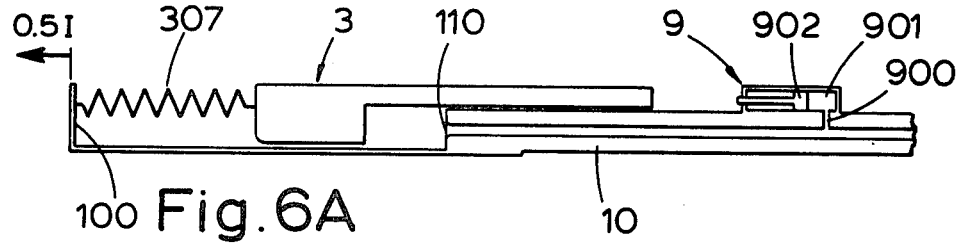
Figure 6B:
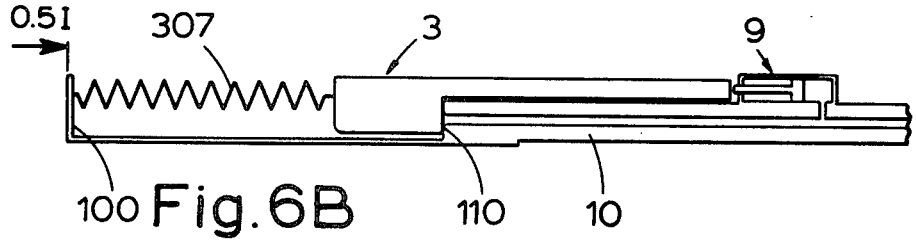

Referring now to FIG. 6A, the gun in accordance with the further aspect of the present invention is shown schematically in its open bolt position where the gun is firing automatically. Assume that the bolt carrier assembly 3 has been given a rearward impulse by the gas piston 902 equal to one half of the firing impulse, where I denotes impulse and that the main drive spring force is sufficient to overcome the energy stored in the rearward motion of the bolt carrier assembly 3 so that the force of the driving spring 307 brings the bolt carrier assembly slowly to a halt before the carrier assembly impacts against anything.

Figure 7A:
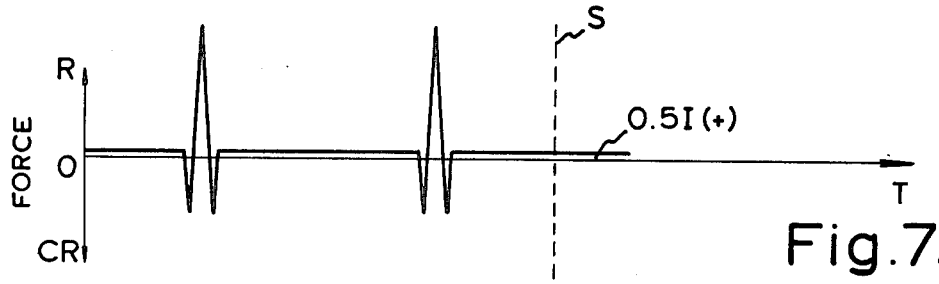

Referring now to FIG. 7A, a graph is shown with an abcisse of time T against an ordinate of reaction R and counter-reaction CR. Two complete cycles of the gun are shown to the left of the broken line S and with the start of a new cycle a steady push is exerted on the rear receiver wall 100 by the spring 307 of 0.5I.

Figure 6C:
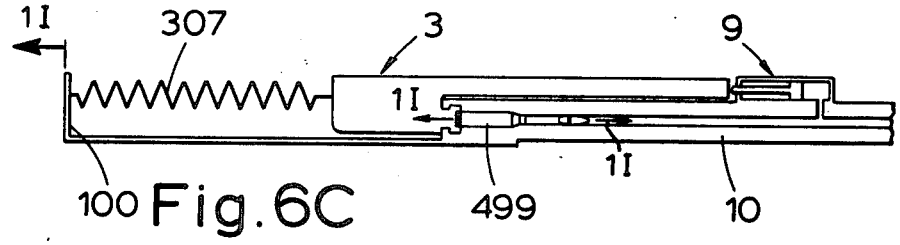
Figure 6D:
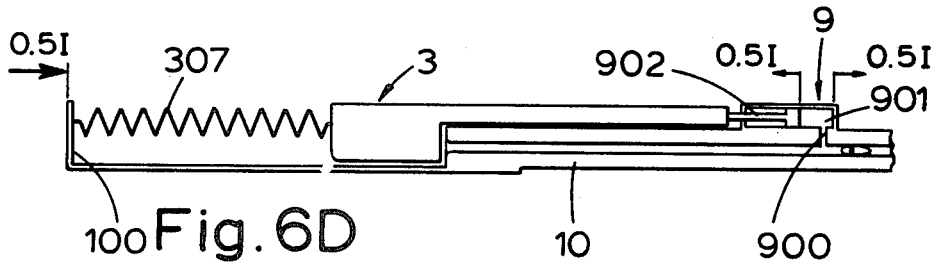
Figure 7B:
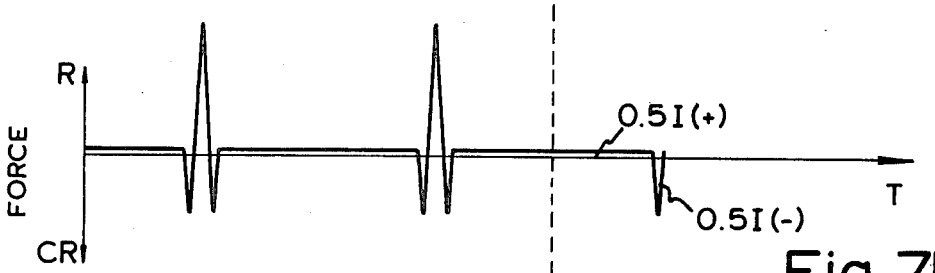
Figure 7C:
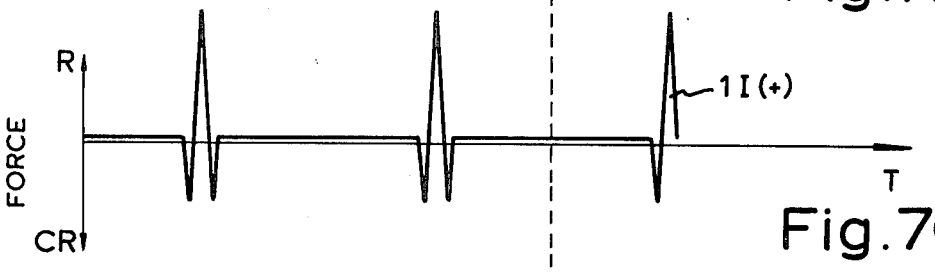
Figure 7D:
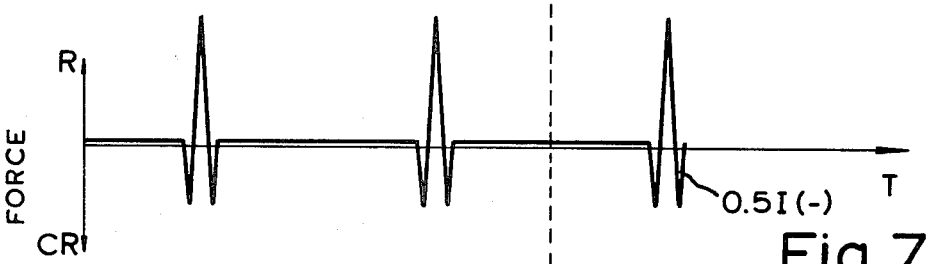

Assuming that the main drive spring 307 exerts a constant pressure then the force of 0.5I will be constant and as a result when the bolt carrier assembly 3 strikes the barrel extension 110, as shown in FIG. 7B, the impulse of 0.5I is applied in a forward direction shown as a counter recoil spike of 0.5I in FIG. 7B. The cartridge 499 in the chamber now fires applying an impulse of 1I in both a forward and a rearward direction, as shown in FIG. 6C, but since the barrel is open the forward impulse of 1I is applied only to the bullet and not the gun, whereas the rearward recoil impulse of 1I is applied through the locked bolt to the receiver 1 with the consequence that the rear receiver wall 100 has a recoil of 1I shown as a positive spike in FIG. 7C. As the bullet passes the gas port 900 so gases flow into the gas cylinder 901. The pressure of the gases in the gas cylinder in both forard and rearward directions, by appropriate dimensioning of the as system, apply 0.5I impulses in the forward and rearward directions (FIG. 6D). However, since the bolt carrier assembly 3 and the main drive spring 307 combination take time to transmit the rearwardly driven impulse to the rear receiver wall 100, the first effect is noticed on the gun a 0.5I impulse in a forward direction, thereby, we believe, reducing the full 1I recoil impulse at the instant of firing by half, thereby providing the softening effect to the recoil as noticed and described above for gas operated guns. The impulse graph for FIG. 6D, shown in FIG. 7D, thus shows the addition of a 0.5I counter-reaction spike.

Figure 6E:
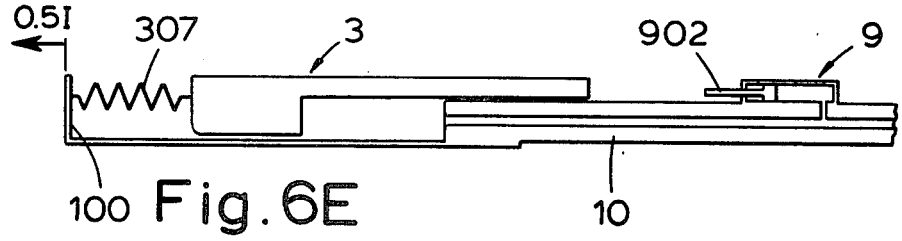
Figure 7E:
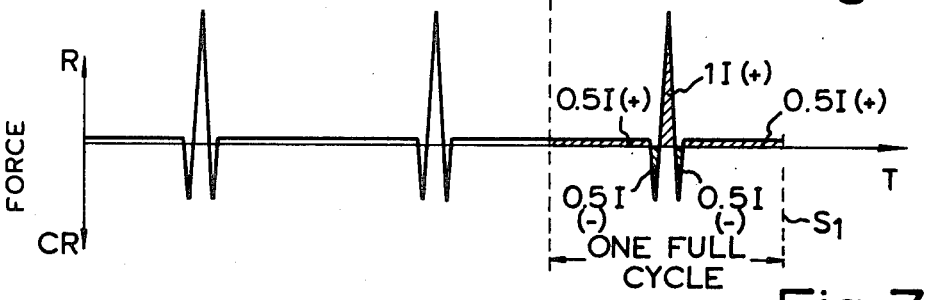

With the bolt carrier assembly shown in the position of FIG. 6E where it is moving rearwardly, the gas impulse in the forward direction has been released by the bullet leaving the barrel and the impulse of 0.5I in the rearward direction (imparted by the gas piston 902) is now being transmitted by the bolt carrier assembly 3 through the main drive spring 307 to the rear receiver wall 100 so as to provide a relatively constant force resulting in a recoil impulse of 0.5I to the rear receiver wall, as shown in FIG. 7E. The main drive spring has sufficient deflection distance and force to retard the motion of the rearward moving bolt carrier assembly and bring it to a halt before it strikes the wall 100. A review of FIG. 7E over one cycle shows that the recoil impulse 1I of the cartridge firing (FIG. 6C and 7C) is cancelled by the two recoil impulses of 0.5I each which occur substantially simultaneously (FIGS. 6B, 7B and 6D and 7D) with the firing impulse 1I. Thus, we are left with a total impulse over one cycle (between S and S') of $0.5I-0.5I+1I-0.5I+0.5I=1I$ with an average impulse (shown shaded in FIG. 7E) of 1I distributed over one complete cycle of the bolt carrier assembly i.e., the firing impulse of 1I occurs substantially simultaneously with the two counter-reaction spikes of 0.5I each. There is, thus, produced a substantially constant push on the rear receiver wall 100 which is, in turn, applied to a user. The user of the gun thus receives a substantially recoil force. Because the recoil is substantially constant, the user's aim is considerably improved due to the improved controllability of the gun i.e., the gun no longer receives unbalanced impulse spikes as produced in conventional gas operated guns. In this respect, attention is directed toward FIGS. 8A and 8B, which show a known gas operated gun having similar (but not the same) parts as FIGS. 6A–E and 7A–E and with the bolt carrier assembly 3' in the position described with reference to FIGS. 6E and 7E.

The conventional bolt carrier assembly 3' and drive spring 307' are not designed with the equation of the further aspect of this invention (hereinafter defined) in mind so that the bolt carrier assembly impacts the rear receier wall, albeit in some known samples through a buffer. Referring to FIG. 8B, a full cycle is shown between the broken lines $S$–$S_1$ following the firing of two previous cartridges. Starting at the beginning of a cycle at S the bolt carrier assembly 3+ will have impacted the rear wall 100' of the receiver due to the cartridge impulse and, thus, a recoil spike A on the rear receiver wall is produced. Under the force of the drive spring, which again is assumed to be consant, the bolt carrier assembly travels forwardly and strikes the barrel extension. A counter recoil impulse of less than 0.5I is typically produced and the cartridge then fires so that a reaction recoil impulse of 1I is produced and a subsequent counter recoil impulse of less than 0.5I is typically provided by gas expanding in the gas cylinder 901'. The bolt carrier assembly 3' is driven rearwardly by the piston at 902' and, again, the force of the spring is presumed constant. Due to the conventional dimensioning of the cycling distance, sprung weight and springing force combinations (as previously defined), the bolt carrier assembly 3' impacts the rear wall of the receiver with a force providing a spike in the recoil (positive) direction.

In FIG. 9, the multiple cycle effect of the first invention is shown as a continuous line since the bolt carrier assembly exerts an approximtely steady push on the rear receiver wall. In distinction, the prior art gas operated automatic gun produces a series of recoil spikes on the rear receiver wall and these are shown in FIG. 10. In both instances, the area under the solid line of the graph (shown shaded) represents an impulse per cycle of 1I but, in FIG. 10 the impulse is not constant resulting in loss of controllability of the gun. The steady push on the receiver wall may also be termed "constant recoil" since the recoil force is substantially constant.

The further aspect of the present invention relies upon the understanding that one half impulse is the exact measure required for the operation of the gas piston, the rearward travel of the bolt carrier assembly, the forward driven bolt carrier assembly and the impact of the bolt carrier assembly against the barrel extension. The equation is expressed in terms significant to the design of the gun and uses the one known value, i.e. cartridge impulse and the three unknown values of bolt carrier distance of cycling travel, spring force that accelerates and retards the bolt carrier assembly and the bolt carrier assembly "sprung weight".

The equation povides the basis of "constant recoil" which can only be achieved if the bolt carrier assembly does not impact the rear receiver wall and which, in turn, can only be achieved practically by providing excess overtravel. As stated earlier, it requires excess energy for a given spring force to achieve excess travel of the bolt carrier assembly, but if excess energy is used without excess distance with which the bolt carrier assembly is able to expend the energy, then impact occurs and the opportunity for increased controllability, reliability and fire power is lost. Reliability and fire power are related to bolt carrier assembly energy (E) and controllability is related to both energy and cartridge impulse. Cartridge impulse (I) and bolt carrier assembly energy (E) may be combined in a single equation giving the basis of constant recoil via the following steps:

Step 1:

The kinematic equation for Impulse is $$I = \frac{WV}{g}.$$

The equation for Energy is $$E = \frac{WV^2}{2G}$$

,

Where W is sprung weight (defined earlier), g is acceleration due to gravity, and V is bolt carrier velocity. The significance of E is that it equals cycling Distance (D) x spring Force (F), both as defined earlier herein. Therefore, the E equation can be expressed as $$D \times F = \frac{WV^2}{2g}$$

Step 2:

by algebraic substitution for V the I and E equations can be combined to read $$D \times F = \frac{I^2 \times g}{W \times 2}$$

Step 3:

because only one half I is wanted the equation becomes $$D \times F = \frac{(0.5I)^2 \times g}{W \times 2}$$

Step 4:

the equation is finally reduced to read cycling Distance x spring Force x sprung Weight$=(0.5I)^2 \times 0.5$ g Step 5:

by using the known cartridge Impulse (which in the case of the present example for a standard 5.56×45 mm cartridge is taken as 0.597 kp-secs)

$$D \times F \times W = (0.5 \times 0.597)^2 \times 0.5 \times 9.81 \quad (1)$$

$$= 0.437 \text{ meters kpkg}$$

with Distance in metres, Weight in Kg and force as Kg-force.

Step 6:

faced with three unknowns it is then necessary to limit the combination of D×F×W to those that will fit within a reasonable gun shape. By applying the same equation to any known gas operated gun it becomes apparent the values DFW must be considerably higher for the second aspect of the present invention than with most known gas operated automatic guns. It also becomes apparent there is an advantage to be gained by exaggerating the distance value as will be subsequently described. In the present invention it was decided that the most favourable combination was distance equals 0.17 meters, bolt carrier weight equals 0.499 kg. Thus, from equation (1) spring force equals 5.154 kg - force=5.154×9.81 newtons=50.561 newtons. In a prototype of the gun values as stated above were used and the gun was test fired against a representative conventional designed gas operated weapon. The prototype out hit the representative prior art weapons by 2.3 to 1.

Although the present invention has been described with reference to a hand held gun, it is to be understood that the present invention is not so limited and a gun incorporating the features of the present invention could be mounted in an aircraft and/or of much greater calibre. Furthermore, although the invention has been described in relation to a hammerless gun, the present invention is applicable to a hammer operated gun firing from a closed bolt position in automatic mode so that after the first cartridge has been fired the bolt carrier can be said to be moving from the open bolt position. Such a hammer operated gun may be arranged to selectively operate in a semi-automatic mode and so the present invention is not be be limited to fully automatic gas operated gun although it is with such guns that the advantageous controllability effects of the equation used in the second aspect of this invention is best applied.

Further information relating to the background theory concerning the further aspect of the present invention will now be given.

The cycling Mass in a recoil operated gun is the combined weight of the bolt and barrel. The cycling Mass in a blowback operated gun is the bolt weight. The cycling Mass in a gas operated gun is the weight of all components driven forward by the main spring.

Both recoil and blowback operated guns use the same principal to acheive "constant recoil" (constant recoil force during automatic burst fire).

If a recoil or blowback gun was fired with its cycling Mass at rest the Mass would be accelerated rearward until its impulse (Mass×Velocity) exactly equalled the cartridge impulse. This would result in an undersirable and inconstant recoil force. The ideal circumstance would be to accelerate the Mass rearward with only half the cartridge impulse. To achieve this the cartridge is fired while the Mass is still moving forward. If the velocity of the forward moving Mass was enough to equal half the cartridge impulse, the cartridge would expend half its impulse to bring the Mass to a hault then accelerate the Mass rearward with the remaining half impulse. The Mass would never impact the rigid structure of the gun while moving forward, and, if the gun has sufficient travel room and spring force, the Mass can be slowly brought to a halt as it travels rearward so that it would not impact the rigid structure at the rear. This principle of firing early is generally called "recoil cancellation", an admitted misnomer. The full recoil impulse of the cartridge is still transmitted to the rigid structure, but the transfer is evenly stretched out over the entire cycle time. Since no impact occurs with the rigid structure the Dynamic Impulse of the moving mass (Mass×Velocity) is transferred to the gun by the spring force and altered to Static Impulse (force×time). If the Mass starts rearward with half impulse, the force of the spring×time to decelerate it to zero velocity in the same force×time required of the spring to accelerate it forward to one half impulse.

The spring force pushes the rigid structure rearward as it decelerated the rearward moving Mass and also pushes the structure rearward as it accelerates the Mass forward. Hence, the rigid structure of the gun receives one half impulse during the time the Mass travels rearward and the other half impulse as the Mass travels forward, totalling one full impulse of recoil force×time.

If a gas operated gun were to have the same smooth transfer of impulse as the recoil and blowback guns, its cycling Mass would start rearward with half impulse, be decelerated to zero velocity by the main spring then accelerate forward to half impulse before firing, giving one full recoil impulse during the rearward and forward motion of the Mass. In this respect, it is identical to the recoil and blowback guns, but as the cycling Mass approaches the barrel extension it behaves quite differently from that of a recoil or blowback gun. Since it has already satisfied the requirement of physics that it deliver exactly one full recoil impulse to the gun, the forward moving Mass with half impulse must now "recoil cancel" the cartridge impulse at the instant of firing. Three events happen substantially simultaneously, 1. the mass impacts against the barrel (rigid structure) and drives it forward with half impulse, 2. at the same instant the cartridge, which is locked into the rigid barrel, fires, driving the barrel rearward with full impulse, and 3. when the bullet is part way down the barrel and has only been accelerated to half impulse, it passes the gas port, gas enters the gas cyclinder and drives the Mass rearward and the barrel forward, each with half impulse.

These three events effectively overlap (in time) and the two forward half impulse neutralise or "recoil cancel" the firing impulse, leaving the Mass flying rearward to complete the cycle and to transfer Dynamic Impulse (M×V) through the spring into the rigid structure as Static Impulse (F×T).

Although the effect of "recoil cancellation" results in the same constant static recoil force for all three gun types, it can be seen that forward impact with the rigid structure is essential in the gas operated gun, but not allowed in the recoil or blowback guns.

In a gas operated gun the Mass is always at rest at the instant of firing. The gas system always meters the same amount of impulse to the Mass (half impulse) so it always starts rearward at the same velocity. If the first shot of a burst is fired with the Mass forward and at rest, i.e. in the closed bolt position, the Mass is accelerated rearward with the same velocity on the first shot as on all subsequent shots of the burst. The first shot, in this case, would lack the "recoil cancelling " effect of the forward moving Mass impacting the barrel just prior to firing so it would have a more abrupt recoil effect on the rigid structure for the first shot, but would, nevertheless, be "in sync" for recoil cancellation and constant recoil for subsequent shots.

If a recoil or blowback operated gun was fired with its cycling Mass forward and at rest it would not only deliver an abrupt "first shot" recoil (similar to the gas operated gun), but the Mass would be driven rearward with one full impulse because its rearward velocity is dependent on the substractive forward Mass impulse of the cycle that preceded it. The first shot is "out of sync" with subsequent cycles and for the next several shots a phenomenon occurs called "galloping" before the cycle settles down. Because of high "first shot" velocity the cycling Mass has trouble with normal cartridge handling functions (particularly feeding and ejecting) which must now function at both high velocity and standard velocity.

To solve all these problems any full automatic gun (whether Gas, Recoil, or Blowback) can be made to fire from the "open bolt" position. The cycling Mass is held to the rear on cease fire. This "saves" the half impulse from the last shot so that, when the trigger is pulled for the next burst, the Mass is accelerated forward by the spring and the first shot is recoil cancelled as are all subsequent shots.

The solution of open bolt firing is adequate for a wearpon that fires full automatic only, but it creates a problem for a dual purpose weapon which fires single shot (semi-automatic) as well. Single shot should be accurate, but if the weapon fires from the "open bolt" position, the recoil effect begins before the shot is fired, the gun lurches and the shot is inaccurate. A dual purpose, selective fire, weapon should, therefore, fire from the "closed bolt" position for single shot and from the "open bolt" position for full automatic.

A gas operated weapon is the only one of the three types that has the potential to fire accurate single shots, have recoil cancellation on full automatic, and work reliably in both modes, with the same amount of impulse driving the bolt carrier rearward and, thus, the same rearward carrier velocity and energy whether the shot was initiated from the open or closed bolt position.

Despite recoil cancellation being known in recoil and blowback operated guns for decades, because of fundamental differences in operation, it was not until the present invention that such a feature has been applied to gas operated guns.

I claim:

1. A gas operated gun for firing a live cartridge of predetermined length comprising a case, a propellant within said case and a bullet at one end of the case arranged to be driven by said propellant, said gun including a receiver having a rear wall at one end and a barrel at the other end thereof, said receiver also having a cartridge feed station, a bolt means movable within said receiver, a main drive spring arranged to cooperate with the bolt means and to urge the bolt means toward the barrel, whereby the product of sprung weight×spring force×cycling distance is equal to $(0.5I)^2\times0.5g$ ±15%, where sprung weight is the total weight in kilograms of all components driven toward the barrel by the main drive spring, the spring force is an average value of spring forces that decelerate the sprung weight as said sprung weight travels away from said barrel and which accelerates the sprung weight as it travels forwardly toward said barrel, cycling distance is the length of allowable travel of the bolt means in meters, I is the cartridge impulse and g is acceleration due to gravity, the receiver and bolt means being arranged so that the bolt means does not impact said rear wall.

2. A gas operated gun as claimed in claim 1 wherein the rearward travel of the bolt means is resisted solely by the compression of the main drive spring.

3. A gas operated gun as claimed in claim 2 wherein said bolt means is movable solely within said receiver.

4. A gas operated gun as claimed in claim 3 wherein a gas means is provided a predetermined distance along said barrel to provide rearward impetus to the bolt means and the main drive spring is mounted on a guide means which is located forwardly adjacent said gas means and rearwardly adjacent said receiver wall.

5. A gas operated gun as claimed in claim 4 wherein a buttstock is provided and the rearward location of the guide means is on the interior of the rear receiver wall with the exterior rear receiver wall being in abutting relationship with the buttstock.

6. A gas operated gun for firing a live cartridge of predetermined length comprising a case, a propellant within said case and a bullet at one end of the case arranged to be driven by said propellant, said gun including a receiver having a rear wall at one end and a barrel at the other end thereof, said receiver also having a cartridge feed station, a bolt means movable within said receiver, a main drive spring arranged to cooperate with the bolt means and to urge the bolt means toward the barrel, whereby the product of sprung weight×spring force×cycling distance is equal to $(0.5I)^2\times0.5g$ ±15%, where sprung weight is the total weight in kilograms of all components driven toward the barrel by the main drive spring, the spring force is an average value of spring forces that decelerate the sprung weight as said sprung weight travels away from said barrel and which accelerates the sprung weight as it travels forwardly toward said barrel, cycling distance is the length of allowable travel of the bolt means in meters, I is the cartridge impulse and g is acceleration due to gravity, the receiver and bolt means being arranged so that the rearward travel of the bolt means is resisted solely by the compression of the main drive spring so that the bolt means does not impact said rear wall, and feed overtravel is provided at least equal to the overall length of a live cartridge.

7. A gas operated gun as claimed in claim 6 wherein I is given by $$\frac{\text{Bullet Weight (kg)} \times \text{Bullet Velocity (mps)}}{\text{g (mpsps)}} + \frac{\text{Powder Weight (kg)} \times \text{Powder Velocity (mps)}}{\text{g (mpsps)}}$$

8. A gas operated gun as claimed in claim 6, wherein for a standard 5.56×45 mm cartridge, $$I=0.597 \text{ kp-secs.}$$

9. A gas operated gun as claimed in claim 6, wherein the product of sprung weight×spring force×cycling distance is equal to $(0.5I)^2\times0.5g\pm5\%$.

10. A gas operated gun as claimed in claim 6, wherein the gun is arranged to fire from the open bolt position in which the bolt means is held behind the feed station by the previous cycle of the bolt means being interrupted prior to a new cycle starting with the bolt means being driven forwardly toward the barrel by the main drive spring.

11. A gas operated gun as claimed in claim 6, wherein the bolt means comprises a reciprocable bolt carrier assembly and a bolt carried thereby.

12. A gas operated gun as claimed in claim 11, wherein the bolt is movable over a predetermined distance with respect to the bolt carrier assembly.

13. A gas operated gun as claimed in claim 11, wherein at a predetermined length along the barrel there is provided a gas port and connected with the gas port a cylinder containing a piston, saidpiston being arranged to contact and provide rearward impetus to the bolt carrier assembly which assembly is extended forwardly longitudinally with the barrel to the region of said gas port.

14. A gas operated gun as claimed in claim 13, wherein the main drive spring is mounted on a guide means which is located forwardly adjacent said cylinder and rearwardly adjacent the receiver rear wall.

15. A gas operated gun as claimed in claim 14, wherein a buttstock is provided and the rearward location of the guide means is on the interior of the rear receiver wall with the exterior rear receive wall being in abutting relationship with the buttstock.

16. A gas operated gun as claimed in claim 6, wherein the gun is arranged to fire from the open bolt position in which the bolt means is held behind the feed station by the previous cycle of the bolt means being interrupted prior to a new cycle starting with the bolt means being driven forwardly toward the barrel by the main drive spring.

17. A gas operated gun as claimed in claim 6, wherein the bolt means comprises a reciprocable bolt carrier assembly and a bolt carried thereby.

18. A gas operatd gun as claimed in claim 17, wherein the bolt is movable over a predetermined distance with respect to the bolt carrier assembly.

19. A gas operated gun as claimed in claim 17, wherein at a predetermined length along the barrel there is provided a gas port and connected with the gas port a cylinder containing a piston, said piston being arranged to contact and provide rearward impetus to the bolt carrier assembly which assembly is extended forwardly longitudinally with the barrel to the region of said gas port.

20. A gas operated gun as claimed in claim 19, wherein the main drive spring is mounted on a guide means which is located forwardly adjacent said cylinder and rearwardly adjacent the receiver rear wall.

21. A gas operated gun as claimed in claim 20, wherein a buttstock is provided and the rearward location of the guide means is on the interior of the rear receiver wall with the exterior rear receiver wall being in abutting relationship with the buttstock.

22. A gas operated gun for firing a live cartridge or predetermined length comprising a case, a propellent within said case and a bullet at one end of the case arranged to be driven by said propellent, said gun including a receiver having a rear wall at one end and a barrel at the other end thereof, said receiver also having a cartridge feed station, a bolt means movable within said receiver, said bolt means comprising a reciprocal bolt carrier assembly and a bolt carried thereby, said bolt being movable over a predetermined distance with respect to the bolt carrier assembly, said barrel having positioned at a predetermined length therealong a gas port, and connected with the gas port there being a cylinder containing a piston, said piston being arranged to contact and provided rearward impetus to the bolt carrier assembly which assembly is extended forwardly longitudinally with the barrel to the region of said gas port, a main drive spring arranged to cooperate with the bolt means and to urge the bolt means toward the barrel, said main drive spring being mounted on a guide means which is located forwardly adjacent said cylinder and rearwardly adjacent the receiver rear wall, whereby the product of sprung weight$\times$spring force$\times$cycling distance is equal to $(0.5I)^2\times0.5g\ \pm15\%$, where sprung weight is the total weight in kilograms of all components driven toward the barrel by the main drive spring, the spring force is an average value of spring forces that decelerate the sprung weight as said sprung weight travels away from said barrel and which accelerates the sprung weight as it travels forwardly toward said barrel, cycling distance is the length of allowable travel of the bolt means in meters, I is the cartridge impulse and g is acceleration due to gravity, the receiver and bolt means being arranged so that the bolt means does not impact said rear wall.

23. A gas operated gun as claimed in claim 22 wherein the rearward travel of the bolt means is resisted solely by the compression of the main drive spring.

24. A gas operated gun as claimed in claim 22 wherein feed overtravel is provided at least equal to the overall length of a live cartridge.

25. A gas operated gun as claimed in claim 22 wherein a buttstock is provided and the rearward location of the guide means is on the interior of the rear receiver wall with the exterior rear receiver wall being in abutting relationship with the buttstock.

* * * * *